US008446103B2

(12) United States Patent
Han et al.

(10) Patent No.: US 8,446,103 B2
(45) Date of Patent: May 21, 2013

(54) LAMP DRIVER

(75) Inventors: Sang Kyoo Han, Seoul (KR); Sung Soo Hong, Seoul (KR); Chung Wook Roh, Seoul (KR); Sang Gab Park, Gyunggi-do (KR); Young Seung Roh, Gyunggi-do (KR); Hyo Joong An, Busan (KR); Heung Gyoon Choi, Gyunggi-do (KR); Han Hee Lee, Gyunggi-do (KR)

(73) Assignee: Samsung Electro-Mechanics Co., Ltd. (KP)

( * ) Notice: Subject to any disclaimer, the term of this patent is extended or adjusted under 35 U.S.C. 154(b) by 281 days.

(21) Appl. No.: 12/887,356

(22) Filed: Sep. 21, 2010

(65) Prior Publication Data

US 2011/0234111 A1 Sep. 29, 2011

(30) Foreign Application Priority Data

Mar. 23, 2010 (KR) ..... 10-2010-0025711

(51) Int. Cl.
*G05F 1/00* (2006.01)
*H05B 37/02* (2006.01)

(52) U.S. Cl.
USPC ..... 315/291; 315/307

(58) Field of Classification Search
USPC ..... 315/291, 307, 308, 312, 246, 200 R, 315/209 R, 224, 274, 276, 275, 279, 306, 315/310, 311
See application file for complete search history.

(56) References Cited

U.S. PATENT DOCUMENTS

| | | | | |
|---|---|---|---|---|
| 7,145,295 | B1 * | 12/2006 | Lee et al. | 315/291 |
| 7,471,287 | B2 * | 12/2008 | Chen et al. | 345/212 |
| 2008/0088254 | A1 * | 4/2008 | Yang | 315/247 |
| 2010/0013412 | A1 * | 1/2010 | Archibald et al. | 315/294 |
| 2010/0019697 | A1 * | 1/2010 | Korsunsky et al. | 315/307 |
| 2010/0026208 | A1 * | 2/2010 | Shteynberg et al. | 315/297 |

FOREIGN PATENT DOCUMENTS

KR 20090051713 A 5/2009

* cited by examiner

*Primary Examiner* — Minh D A
(74) *Attorney, Agent, or Firm* — Lowe Hauptman Ham & Berner, LLP

(57) ABSTRACT

There is provided a lamp driver including: a power supplying part switching an input power, supplying a driving power to at least one lamp, and controlling brightness of the at least one lamp according to a dimming signal; a signal supplying part supplying a first comparison result signal obtained by comparing a current sensing signal sensing a current flowing through the at least one lamp with a reference signal having a current level set beforehand when the dimming signal is a logic high signal, and supplying a second comparison result signal having a voltage level set beforehand when the dimming signal is a logic low signal; and a controlling part controlling the switching of the power supplying part according to a signal being supplied by the signal supplying part.

4 Claims, 7 Drawing Sheets

LAMP DRIVER

CROSS-REFERENCE TO RELATED APPLICATIONS

This application claims the priority of Korean Patent Application No. 10-2010-0025711 filed on Mar. 23, 2010, in the Korean Intellectual Property Office, the disclosure of which is incorporated herein by reference.

BACKGROUND OF THE INVENTION

1. Field of the Invention

The present invention relates to a lamp driver, and more particularly, to a lamp driver controlling driving power being supplied to a lamp to suppress a transient state thereof, depending on a first comparison result signal obtained by comparing a current sensing signal sensing a current flowing through the lamp according to the on/off state of a dimming signal with a reference signal set beforehand, or on a second comparison result signal set beforehand.

2. Description of the Related Art

With the advent of the information age, the demand for a high performance display capable of presenting information in various formats such as images, graphics and text for the rapid transmission thereof has been rapidly increasing. In order to meet the demand, the display industry is undergoing rapid growth.

Particularly, a Liquid Crystal Display (LCD) has been greatly improved as a next-generation high-tech display device in recent years since it has low power consumption and is relatively thin and lightweight as compared with a cathode ray tube (CRT). The LCD has been widely used in an electronic watch, an electronic calculator, a computer, a television and the like.

Meanwhile, the LCD includes a liquid crystal panel displaying an image and a backlight unit supplying light to the liquid crystal panel.

The liquid crystal panel has a thin-film transistor substrate including a gate line, a data line, a thin-film transistor, a pixel electrode and the like, and a color filter substrate including a color filter, a common electrode and the like. When a pixel voltage is applied to the liquid crystal panel, the liquid crystal panel is driven to adjust the transmittance of the light supplied by the backlight unit so that it can display an image.

A fluorescent lamp, a light emitting diode (LED) or the like is used as the backlight unit. In recent years, the LED allowing for low power consumption and superior color reproduction has been used a lot as the backlight unit.

Meanwhile, such an LCD uses a dimming control method to adjust screen brightness through the brightness control of the backlight unit, i.e., the fluorescent lamp or the LED. A control signal used in the dimming control method employs a Pulse Width Modulation (PWM) method to control the amount of power supplied to the fluorescent lamp or the LED according to duty of the control signal to thereby adjust brightness.

Meanwhile, power is supplied to the fluorescent lamp or the LED through the conversion of input power based on a feedback signal of the current flowing through the fluorescent lamp or the LED. At this time, when a dimming control signal having a preset duty ratio or less is inputted, the voltage level of the feedback signal becomes lower than a reference level, so that a switching IC employed in a power conversion circuit may stop its switching operation.

However, the duty of the dimming control signal may be minimized instantaneously and then provided normally. In this case, the switching IC detects a feedback signal having a voltage level lower than the reference level and stops power supply. Thereafter, when the duty of the dimming control signal is provided normally, the switching IC restarts power supply. At this time, power is to be in a transient state instantaneously so that a flicker may be caused.

SUMMARY OF THE INVENTION

An aspect of the present invention provides a lamp driver controlling driving power being supplied to a lamp to suppress a transient state thereof, depending on a first comparison result signal obtained by comparing a current sensing signal sensing a current flowing through the lamp according to the on/off state of a dimming signal with a reference signal set beforehand, or on a second comparison result signal set beforehand.

According to an aspect of the present invention, there is provided a lamp driver including: a power supplying part switching an input power, supplying a driving power to at least one lamp, and controlling brightness of the at least one lamp according to a dimming signal; a signal supplying part supplying a first comparison result signal obtained by comparing a current sensing signal sensing a current flowing through the at least one lamp with a reference signal having a current level set beforehand when the dimming signal is a logic high signal, and supplying a second comparison result signal having a voltage level set beforehand when the dimming signal is a logic low signal; and a controlling part controlling the switching of the power supplying part according to a signal being supplied by the signal supplying part.

The signal supplying part may include a switch electrically connected between a current sensing signal input terminal, to which the current sensing signal is inputted, and a reference signal input terminal, to which the reference signal is inputted, wherein the switch is switched off when the dimming signal is the logic high signal so that the current sensing signal input terminal and the reference signal input terminal are electrically separated, and the switch is switched on when the dimming signal is the logic low signal so that the current sensing signal input terminal and the reference signal input terminal are electrically connected to supply the reference signal to the current sensing signal input terminal; and a comparator outputting the first comparison result signal by comparing a signal inputted from the current sensing signal input terminal with the reference signal or outputting the second comparison result signal.

The controlling part may include a signal generating portion generating a pulse width modulation (PWM) signal or a pulse frequency modulation (PFM) signal being set according to the first comparison result signal or the second comparison result signal from the signal supplying part; and a gate signal generating portion generating a gate signal by performing a logic operation between a signal from the signal generating portion and the dimming signal.

The power supplying part may include a switching portion switching the input power; a driving portion controlling the switching of the switching portion according to the controlling of the controlling part; a transforming portion transforming the switched power from the switching portion according to a preset winding ratio; a rectifying portion rectifying the transformed power from the transforming portion and supplying the rectified power to the at least one lamp; and a brightness controlling portion controlling the brightness of the at least one lamp by switching on and off the power flowing through the at least one lamp according to the dimming signal.

The at least one lamp may include at least one light emitting diode (LED) or an LED array having a plurality of LEDs connected in series.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
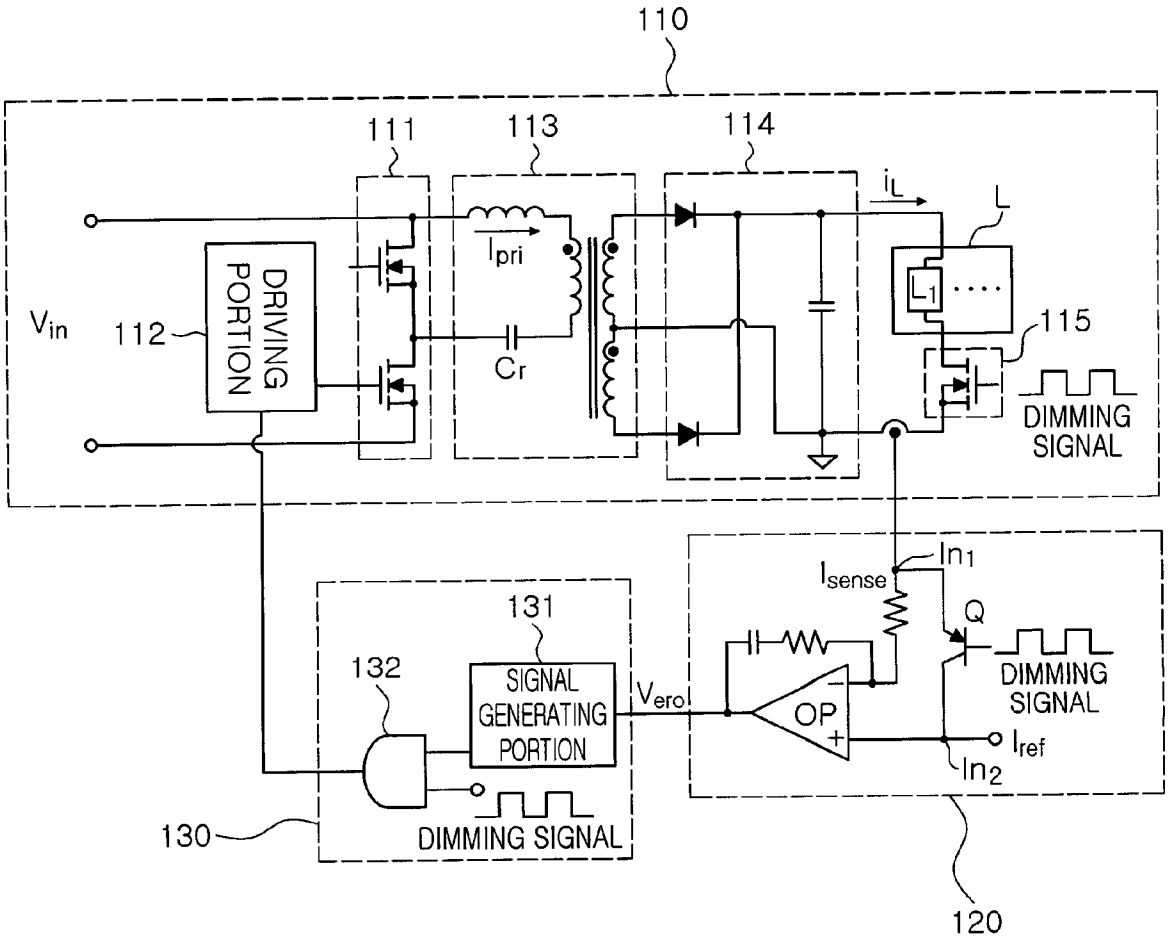
FIG. 1 is a schematic view illustrating the configuration of a lamp driver according to an exemplary embodiment of the present invention.

FIG. 1 is a schematic view illustrating the configuration of a lamp driver according to an exemplary embodiment of the present invention.

With reference to FIG. 1, a lamp driver 100 according to an exemplary embodiment of the invention may include a power supplying part 110, a signal supplying part 120, and a controlling part 130.

The power supplying part 110 may include a switching portion 111, a driving portion 112, a transforming portion 113, a rectifying portion 114, and a brightness controlling portion 115.

The switching portion 111 may include at least two switches connected to one another in series with a power input terminal to which an input power Vin is inputted, so that the switching portion 111 may switch the input power Vin according to driving control of the driving portion 112.

The driving portion 112 may control the driving of the switches of the switching portion 111 according to a gate signal from the controlling part 130.

The transforming portion 113 may include at least one primary winding and at least one secondary winding that are electromagnetically coupled to have a winding ratio therebetween. The transforming portion 113 may transform a voltage level of the switched power from the switching portion 111, according to the winding ratio. A resonant capacitor Cr may be provided between the switches of the switching portion 111 and the primary winding of the transforming portion 113.

The rectifying portion 114 may rectify the transformed power from the transforming portion 113 to supply the rectified power to at least one lamp L1 of the lamp portion L.

The brightness controlling portion 115 may switch the current flowing through the at least one lamp L1 of the lamp portion L on and off according to a dimming signal supplied from the outside, to thereby control the brightness of light emitted from the at least one lamp L1.

The at least one lamp L1 of the lamp portion L may be at least one light emitting diode (LED) or an LED array having a plurality of LEDs connected in series.

The signal supplying part 120 may include a switch Q and a comparator OP.

The signal supplying part 120 may sense the current flowing through the lamp L1 of the lamp portion L, more particularly, the current flowing through the lamp L1 under the control of the brightness controlling portion 115. A current sensing signal Isense, sensing the current flowing through the lamp L1, may be inputted to the comparator OP, and a reference signal Iref having a preset current level may also be inputted to the comparator OP. Herein, the switch Q may be electrically connected between a current sensing signal input terminal In1, to which the current sensing signal Isense is inputted, and a reference signal input terminal In2, to which the reference signal Iref is inputted.

The switch Q may be configured as a PNP transistor and be switched on and off according to a dimming signal. When the dimming signal is a logic high signal having a high voltage level, the switch Q may be switched off. When the dimming signal is a logic low signal having a low voltage level, the switch Q may be switched on.

When the dimming signal is a logic high signal, the switch Q is turned off so that the current sensing signal input terminal In1 and the reference signal input terminal In2 are electrically separated. The current sensing signal Isense is inputted to a negative terminal of the comparator OP and the reference signal Iref is inputted to a positive terminal of the comparator OP. The compartor OP may compare the signal level of the current sensing signal Isense with that of the reference signal Iref to thereby provide a first comparison result signal.

On the other hand, when the dimming signal is a logic low signal, the brightness controlling portion 115 is switched off so that the level of the current sensing signal Isense becomes '0.' At this time, the switch Q is turned on so that the current sensing signal input terminal In1 and the reference signal input terminal In2 are electrically connected, and thus the reference signal Iref can be inputted to the current sensing signal input terminal In1. The comparator OP may compare the reference signal Iref inputted to the negative terminal thereof with the reference signal Iref inputted to the positive terminal thereof to thereby provide a second comparison result signal.

The controlling part 130 may include a signal generating portion 131 and a gate signal generating portion 132.

The signal generating portion 131 may generate a Pulse Width Modulation (PWM) signal or a Pulse Frequency Modulation (PFM) signal corresponding to the signal level of the first comparison result signal or the second comparison result signal from the comparator OP.

The gate signal generating portion 132 may provide a gate signal by logically multiplying the PWM or PFM signal from the signal generating portion 131 by the dimming signal. The gate signal may be transmitted to the driving portion 112.

Figure 2A:
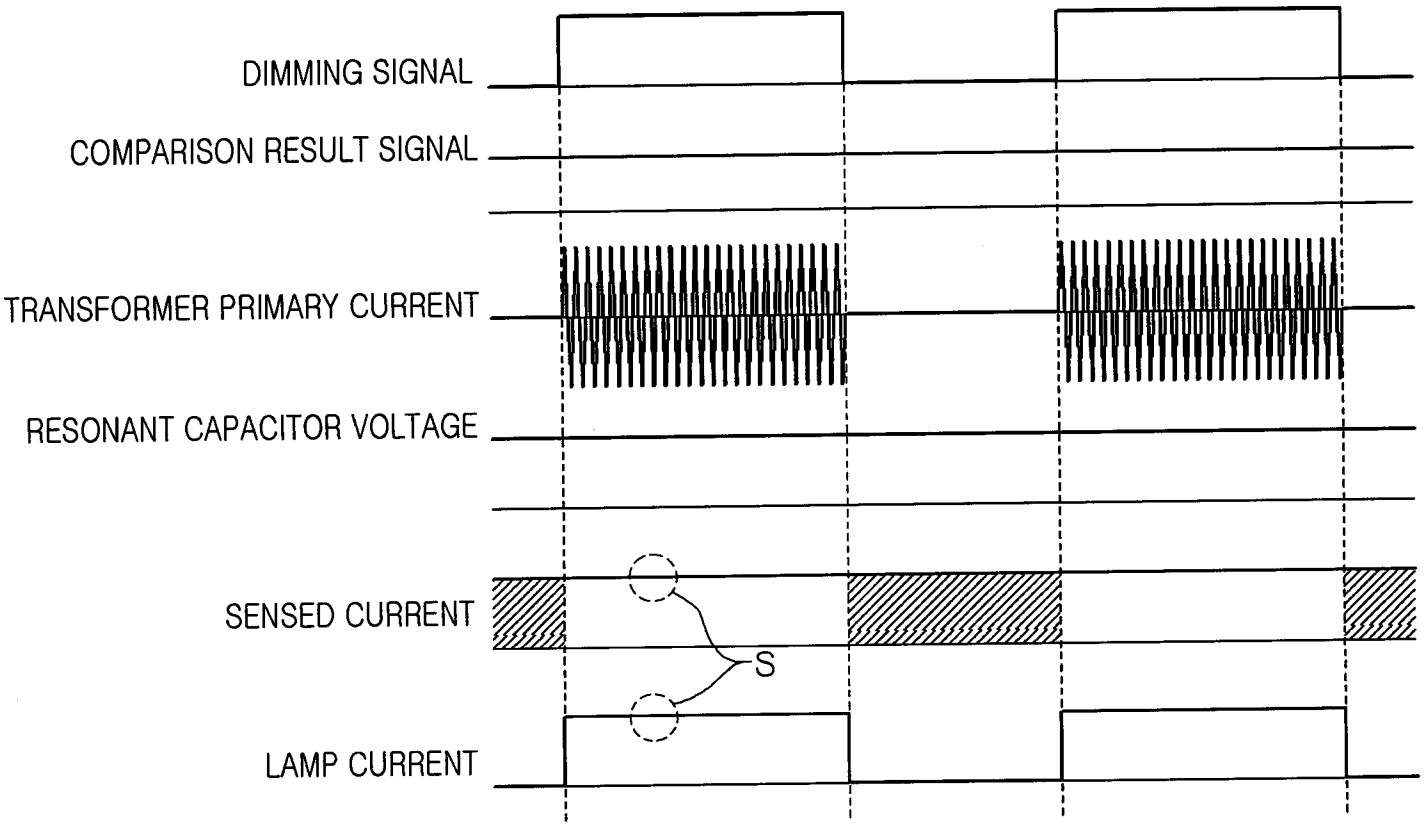
FIGS. 2A and 2B are graphs illustrating theoretical signal waveforms of main elements of a lamp driver according to an exemplary embodiment of the present invention.
Figure 2B:
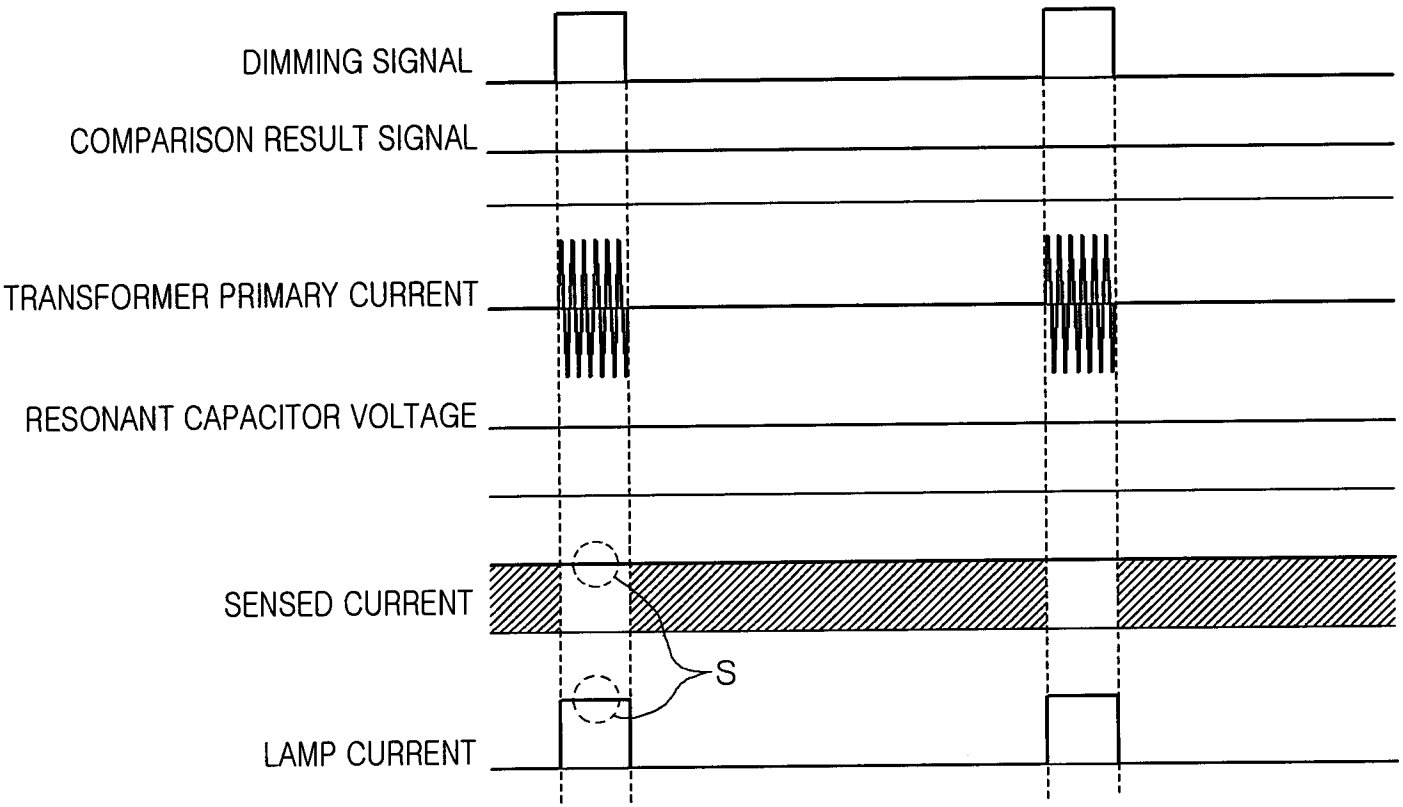

FIGS. 2A and 2B are graphs illustrating theoretical signal waveforms of main elements of a lamp driver according to an exemplary embodiment of the present invention.

FIG. 2A is a graph illustrating signal waveforms of main elements of a lamp driver according to an exemplary embodiment of the present invention when a duty ratio of a dimming signal is set to be 50%. FIG. 2B is a graph illustrating signal waveforms of main elements of a lamp driver according to an exemplary embodiment of the present invention when a duty ratio of a dimming signal is set to be 10%.

With reference to FIGS. 2A and 2B, when a dimming signal is a logic high signal, the switch Q is switched off so that a current sensing signal Isense, sensing a lamp current $I_L$, is applied to the comparator OP, whereby the current level of an output current may be controlled to correspond to the signal level of a reference signal Iref. On the other hand, when the dimming signal is a logic low signal, the switch Q is switched on so that the reference signal Iref is applied to the comparator OP as the current sensing signal Isense even though the lamp current $I_L$ is '0,' whereby the controlling part 130 operates as it does in the case of a steady output current.

That is, since the signal level of the current sensing signal Isense is always identical to that of the reference signal Iref, irrespective of the case in which the signal level of the dimming signal is high or low, the comparator OP always outputs a comparison result signal Vero having a steady level. Accordingly, the lamp driver 100 according to the embodiment of the invention may output a steady lamp current without a transient state during the level shifting of the dimming signal, as denoted by 'S' in FIG. 2A. Also, the lamp driver 100 may output a steady lamp current without a transient state even when the duty ratio of the dimming signal is very low, as denoted by 'S' in FIG. 2B.

Figure 3A:
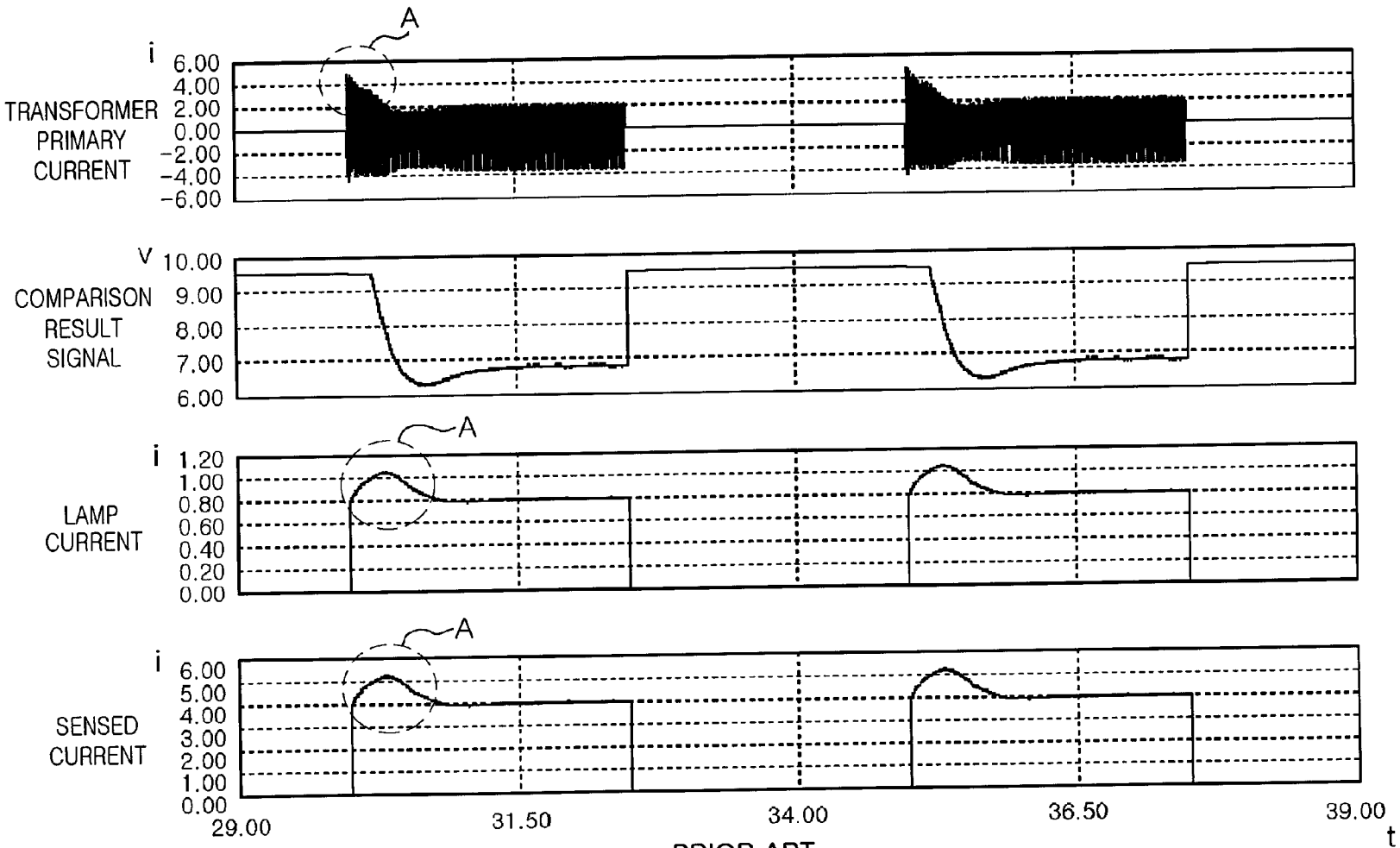
PRIOR ART FIG. 3A
FIGS. 3A and 3B are experimental graphs illustrating signal waveforms of main elements of a lamp driver according to the related art.
Figure 3B:
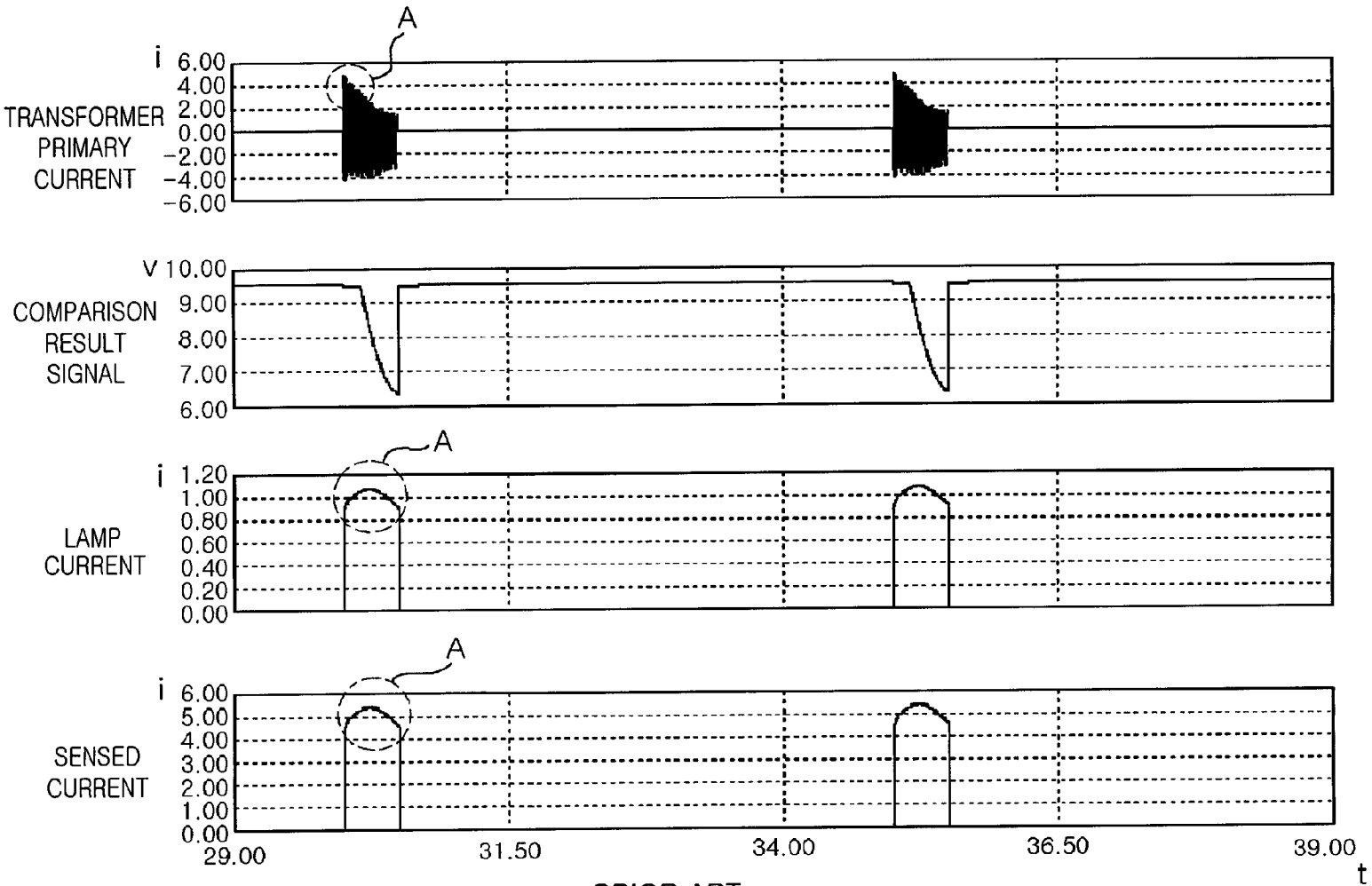
PRIOR ART FIG. 3B
Figure 4A:
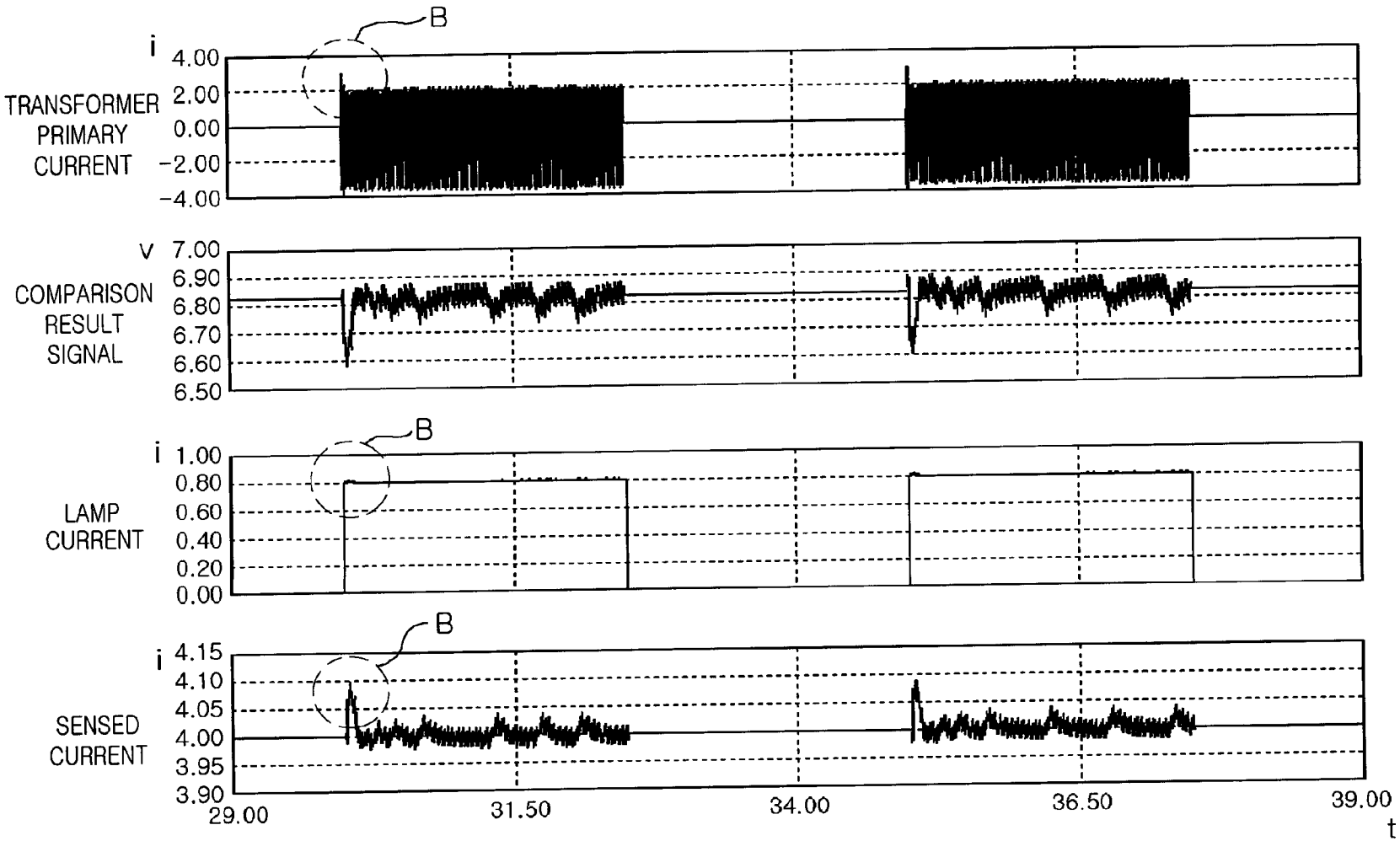
FIGS. 4A and 4B are experimental graphs illustrating signal waveforms of main elements of a lamp driver according to an exemplary embodiment of the present invention.
Figure 4B:
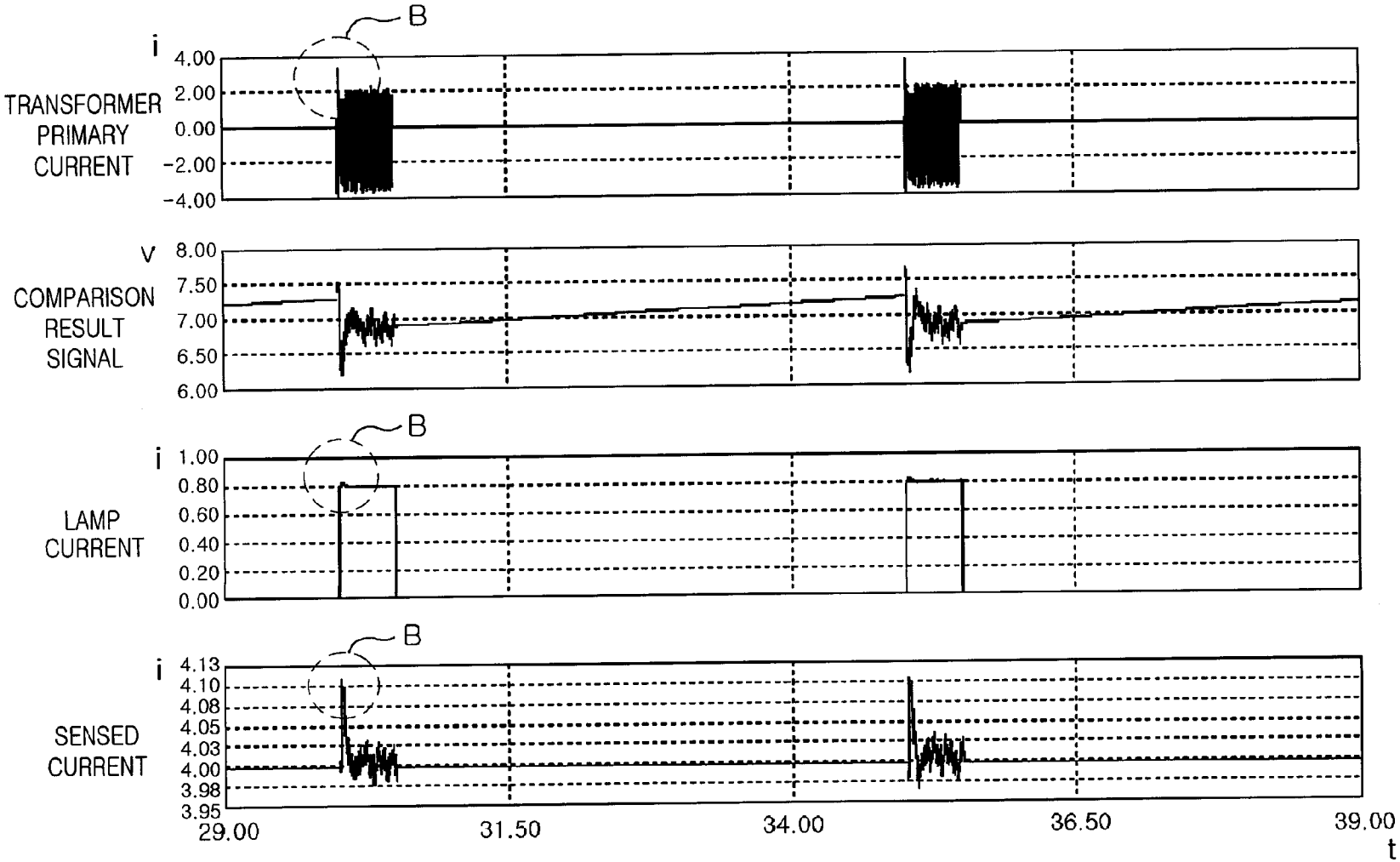

FIGS. 3A and 3B are graphs illustrating signal waveforms of main elements of a lamp driver according to the related art. FIGS. 4A and 4B are graphs illustrating signal waveforms of main elements of a lamp driver according to an exemplary embodiment of the present invention.

FIG. 3A is graphs illustrating signal waveforms of main elements of a lamp driver according to the related art when a duty ratio of a dimming signal is set to be 50%. FIG. 3B is graphs illustrating signal waveforms of main elements of a lamp driver according to the related art when a duty ratio of a dimming signal is set to be 10%.

With reference to FIGS. 3A and 3B, in the case of a lamp driver according to the related art, when a dimming signal is shifted from a logic low signal to a logic high signal, a current in the primary side of the transforming portion temporarily undergoes a transient event as denoted by 'A.' Since the current is transmitted to the lamp through the rectifying portion, the current inputted into the lamp and the sensed current also have a transient event, as denoted by 'A'.

FIG. 4A is graphs illustrating signal waveforms of main elements of a lamp driver according to an exemplary embodiment of the present invention when a duty ratio of a dimming signal is set to be 50%. FIG. 4B is graphs illustrating signal waveforms of main elements of a lamp driver according to an exemplary embodiment of the present invention when a duty ratio of a dimming signal is set to be 10%.

With reference to FIGS. 4A and 4B, in the case of a lamp driver according to the present invention, even though a dimming signal is shifted from a logic low signal to a logic high signal, the power supplying part recognizes a case in which current flows through the lamp steadily by a reference signal Iref. At this time, a current in the primary side of the transforming portion is restricted so as to move out of a transient state, as denoted by 'B,' and accordingly, the current inputted to the lamp through the rectifying portion and the sensed current are also restricted so as to move out of a transient state, as denoted by 'B.'

As described above, according to exemplary embodiments of the invention, a first comparison result signal obtained by comparing a current sensing signal sensing a current flowing through a lamp according to the on/off state of a dimming signal with a reference signal set beforehand or a second comparison result signal set beforehand is supplied to a switch control circuit such that power supply is controlled to allow the switch control circuit to recognize as if the current flows through the lamp steadily, whereby the transient state of the driving power supplied to the lamp may be suppressed.

As set forth above, according to exemplary embodiments of the invention, a driving power supplied to a lamp is controlled to suppress the transient state thereof, depending on a first comparison result signal obtained by comparing a current sensing signal sensing a current flowing through the lamp according to the on/off state of a dimming signal with a reference signal set beforehand, or on a second comparison result signal set beforehand, thereby driving the lamp stably and avoiding a flicker that may caused on a display screen.

While the present invention has been shown and described in connection with the exemplary embodiments, it will be apparent to those skilled in the art that modifications and variations can be made without departing from the spirit and scope of the invention as defined by the appended claims.

What is claimed is:

1. A lamp driver, comprising:

a power supplying part configured to
- switch an input power,
- supply a driving power to at least one lamp, and
- control brightness of the at least one lamp according to a dimming signal;

a signal supplying part configured to
- output a first comparison result signal obtained by comparing i) a current sensing signal obtained by sensing a current flowing through the at least one lamp with ii) a reference signal having a current level set in advance when the dimming signal is a logic high signal, and
- output a second comparison result signal having a voltage level set in advance when the dimming signal is a logic low signal; and a controlling part configured to control the switching of the power supplying part based on an output signal of the signal supplying part, wherein the signal supplying part comprises:
- a switch electrically connected between a current sensing signal input terminal, to which the current sensing signal is inputted, and a reference signal input terminal, to which the reference signal is inputted, wherein the switch is switched off when the dimming signal is the logic high signal so that the current sensing signal input terminal and the reference signal input terminal are electrically disconnected from each other, and the switch is switched on when the dimming signal is the logic low signal so that the current sensing signal input terminal and the reference signal input terminal are electrically connected to each other to supply the reference signal to the current sensing signal input terminal; and
- a comparator configured to output either the first comparison result signal or the second comparison result signal by comparing a signal inputted from the current sensing signal input terminal with the reference signal.

2. The lamp driver of claim 1, wherein the controlling part comprises:
- a signal generating portion configured to generate a pulse width modulation (PWM) signal or a pulse frequency modulation (PFM) signal being set according to the first comparison result signal or the second comparison result signal from the signal supplying part; and
- a gate signal generating portion configured to generate a gate signal by performing a logic operation between an output signal of the signal generating portion and the dimming signal.

3. The lamp driver of claim 1, wherein the power supplying part comprises:
- a switching portion configured to switch the input power;

a driving portion configured to control the switching of the switching portion according to the controlling of the controlling part;

a transforming portion configured to transform the switched power from the switching portion according to a preset winding ratio;

a rectifying portion configured to rectify the transformed power from the transforming portion and supply the rectified power to the at least one lamp; and a brightness controlling portion configured to control the brightness of the at least one lamp by switching on and off the power flowing through the at least one lamp according to the dimming signal.

4. The lamp driver of claim 1, wherein the at least one lamp comprises at least one light emitting diode (LED) or an LED array having a plurality of LEDs connected in series.

* * * * *

UNITED STATES PATENT AND TRADEMARK OFFICE

CERTIFICATE OF CORRECTION

PATENT NO. : 8,446,103 B2
APPLICATION NO. : 12/887356
DATED : May 21, 2013
INVENTOR(S) : Han et al.

It is certified that error appears in the above-identified patent and that said Letters Patent is hereby corrected as shown below:

On the title page, Item [73] should read as follows:

Samsung Electro-Mechanics Co., Ltd., Suwon, Gyunggi-do, Korea (KR)

Signed and Sealed this
Twenty-fifth Day of March, 2014

Michelle K. Lee

Michelle K. Lee
*Deputy Director of the United States Patent and Trademark Office*